US009022131B2

(12) United States Patent
Kaase

(10) Patent No.: US 9,022,131 B2
(45) Date of Patent: May 5, 2015

(54) HYDRODYNAMIC JOURNAL BEARING FLOW CONTROL BUSHING FOR A ROTATING CONTROL DEVICE

(71) Applicant: National Oilwell Varco, L.P., Houston, TX (US)

(72) Inventor: Keith George Kaase, Houston, TX (US)

(73) Assignee: National Oilwell Varco, L.P., Houston, TX (US)

( * ) Notice: Subject to any disclaimer, the term of this patent is extended or adjusted under 35 U.S.C. 154(b) by 237 days.

(21) Appl. No.: 13/719,522

(22) Filed: Dec. 19, 2012

(65) Prior Publication Data

US 2013/0161029 A1 Jun. 27, 2013

Related U.S. Application Data

(60) Provisional application No. 61/579,134, filed on Dec. 22, 2011.

(51) Int. Cl.
*E21B 33/068* (2006.01)

(52) U.S. Cl.
CPC ..... *E21B 33/068* (2013.01)

(58) Field of Classification Search
USPC ..... 166/383, 387, 84.3, 84.4, 85.4, 88.4
See application file for complete search history.

(56) References Cited

U.S. PATENT DOCUMENTS

| | | | | |
|---|---|---|---|---|
| 4,098,341 | A | 7/1978 | Lewis | |
| 4,383,577 | A | 5/1983 | Pruitt | |
| 5,588,491 | A * | 12/1996 | Brugman et al. | 166/383 |
| 5,662,171 | A | 9/1997 | Brugman | |
| RE38,249 | E | 9/2003 | Tasson et al. | |
| 2003/0064853 | A1 * | 4/2003 | Rockey et al. | 475/331 |
| 2003/0106712 | A1 | 6/2003 | Bourgoyne | |

FOREIGN PATENT DOCUMENTS

WO 03042485 5/2003

OTHER PUBLICATIONS

European Search Report dated Mar. 25, 2013 for corresponding European Application No. EP 12199290.3 (7 pgs.).

* cited by examiner

*Primary Examiner* — William P Neuder
(74) *Attorney, Agent, or Firm* — Derek V. Forinash; Porter Hedges, LLP.

(57) ABSTRACT

A rotating control device comprises an outer housing having a bore for receiving a tubular member. An inner housing and a piston assembly are rotatably disposed within the outer housing. An annular sealing assembly is disposed between the piston assembly and the inner housing so that axial movement of the piston assembly moves the annular sealing assembly into sealing engagement with the inner housing and the tubular member. A plurality of bearings is disposed between the inner housing and the outer housing. At least one of the plurality of bearings is a hydrodynamic journal bearing.

17 Claims, 2 Drawing Sheets

HYDRODYNAMIC JOURNAL BEARING FLOW CONTROL BUSHING FOR A ROTATING CONTROL DEVICE

CROSS-REFERENCE TO RELATED APPLICATIONS

This application claims priority to U.S. Patent Application Ser. No. 61/579,134, titled Hydrodynamic Journal Bearing Flow Control Bushing for a Rotating Control Device, which was filed Dec. 22, 2011. This priority application is hereby incorporated by reference in its entirety into the present application, to the extent that it is not inconsistent with the present application.

BACKGROUND

This disclosure relates generally to methods and apparatus for controlling wellbore pressure during drilling processes. More specifically, this disclosure relates to rotating control devices for use in hydrocarbon recovery operations that can withstand high wellbore pressures while maintaining sealed engagement with a rotating tubular.

Rotating control devices generally include an annular sealing member that is supported within a rotating inner body and a stationary outer body. Hydraulic pressure is applied to the annular sealing member to effectuate a seal against a wellbore tubular that is disposed within the rotating control device. The sealing member and the inner body, which is rotatably supported on bearings coupled to the outer body, rotate with the wellbore tubular. In this manner, rotating control devices allow for elevated wellbore pressure to be maintained while the wellbore tubular is rotated, enabling activities such as underbalanced drilling.

Under their normal operating conditions, rotating control devices are often subjected to high pressure and rotational speeds during operation. Therefore, the rotating components and the bearings that support the components have to be designed to handle these loads. As components begin to wear or are damaged, operation of the rotating control device will be effected and drilling operations will eventually have to be suspended to allow for maintenance or replacement of worn components.

Thus, there is a continuing need in the art for rotating control devices that overcome these and other limitations of the prior art.

BRIEF SUMMARY OF THE DISCLOSURE

In certain embodiments, a rotating control device comprises an outer housing having a bore for receiving a tubular member. An inner housing and a piston assembly are rotatably disposed within the outer housing. An annular sealing assembly is disposed between the piston assembly and the inner housing so that axial movement of the piston assembly moves the annular sealing assembly into sealing engagement with the inner housing and the tubular member. A plurality of bearings is disposed between the inner housing and the outer housing. At least one of the plurality of bearings is a hydrodynamic journal bearing.

BRIEF DESCRIPTION OF THE DRAWINGS

For a more detailed description of the embodiments of the present disclosure, reference will now be made to the accompanying drawings.

DETAILED DESCRIPTION

Figure 1:
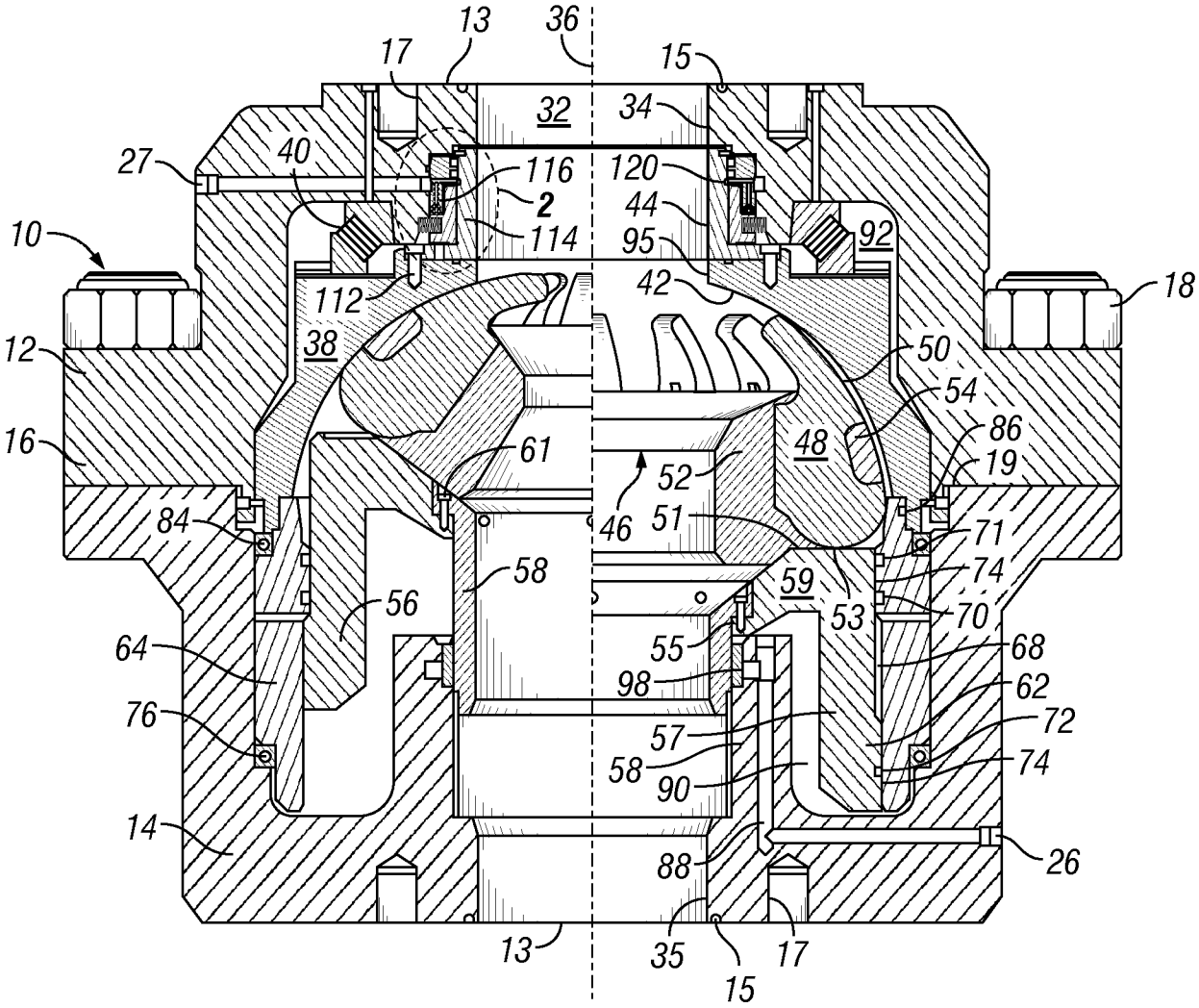
FIG. 1 is a partial sectional view of a rotating control device.

It is to be understood that the following disclosure describes several exemplary embodiments for implementing different features, structures, or functions of the invention. Exemplary embodiments of components, arrangements, and configurations are described below to simplify the present disclosure; however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the exemplary embodiments presented below may be combined in any combination of ways, i.e., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. Furthermore, as it is used in the claims or specification, the term "or" is intended to encompass both exclusive and inclusive cases, i.e., "A or B" is intended to be synonymous with "at least one of A and B," unless otherwise expressly specified herein. For the purposes of this application, the term "real-time" means without significant delay.

Referring initially to FIG. 1, a rotating control device 10 is shown with the annular sealing assembly 46 open on the right side of the figure, while the left side of the same figure shows the sealing assembly 46 in the closed position for engagement with an oilfield tubular. Rotating control device 10 includes a stationary outer housing 12, which may be formed from lower housing 14 and upper housing 16 each having mating flanges for secured engagement by conventional bolts 18. A static seal 19 provides sealed engagement between the lower housing 14 and the upper housing 16. Each end of the stationary housing 12 can include a planar surface 13 with a groove 15 and threaded holes 17 that facilitate sealed engagement with conventional oilfield equipment.

The stationary housing 12 defines a cylindrical bore 32 through the rotating control device 10, which determines the maximum size of the tubular which may be used with a particular assembly 10. The upper and lower inner cylindrical walls 34 and 35 of the housing 12 thus determine the nominal diameter of the rotating control device 10. The stationary housing 12 thus may define a vertical centerline 36 which is coaxial with the centerline of the tubular passing through the rotating control device 10.

The rotating control device 10 includes a rotatable inner housing 38 which is rotatably guided by a thrust bearing 40 that is in engagement with the stationary housing 12 and the rotatable inner housing 38. An inner housing sleeve 44 is coupled to the rotatable inner housing 38 and has an inner diameter that is substantially equal to the diameter of cylindrical wall 34 of the stationary housing 12. The rotatable inner housing 38 includes a spherical surface 42 having a center on or substantially adjacent the centerline 36.

A annular sealing assembly 46 is provided within the rotatable inner housing 38, and can include a plurality of circumferentially arranged metal elements 48, an annular elastomeric sealing element 52, and an outer annular sealing element 54. Each of the metal elements 48 has a curved outer surface 50 for sliding engagement with the similarly configured spherical surface 42 on the inner housing. Annular elastomeric element 52 provides for sealing engagement with the tubular, while the outer annular elastomeric element 54 provides sealing engagement between the metal elements 48 and the rotatable inner housing 38.

The rotating control device 10 includes an axially movable piston 56 that is constructed from a outer ring member 57, an inner ring member 58, and an upper collar 59 interconnecting the ring members 57 and 58. For manufacturing purposes, the collar 59 and the outer ring member 57 may be formed as one component, which may be interconnected with the inner ring member 58 by conventional cap screws 61. A static seal 55 seals between the outer ring member 57 and the upper collar 59. A lower rotary seal 98 seals between the inner ring member 58 and the lower housing 14. An upper supporting surface 51 on the piston 56 contacts the lower surface 53 of the metal elements 48. Accordingly, axial movement of the piston 56 causes corresponding axial and radial movement of the annular sealing assembly 46, thereby controlling the closing and opening of the annular sealing assembly 46 on a tubular.

When the sealing assembly 46 is rotating in sealed engagement with a tubular, the piston 56 and the adapter ring 64 are also rotating members. The adapter ring is supported with respect to the outer housing 12 by a lower bearing 76 and an upper bearing 84. A lower end 62 of the piston 56 is provided with an elastomeric seal 72 for sealing engagement with an adapter ring 64. A fluid passageway through the adapter ring 64 provides continuous fluid communication between a chamber 68 and an annular gap between the adapter ring 64 and the lower housing 14. Another elastomeric seal 70 and a backup elastomeric seal 71 provide sealing engagement between an upper end of the adapter ring 64 and the piston 56. Upper and lower wear bands 74 may be provided to centralize the piston 56 within the adapter ring 64, and to minimize sliding friction when the piston is moved axially relative to the adapter ring.

When closing the annular sealing assembly 46, pressurized fluid passes through fluid input port 26 and passageway 88 into the closing chamber 90 between the outer and inner ring members 57, 58 and beneath upper collar 59 of the piston 56. Fluid pressure to the rotating control device 10 is preferably controlled in response to sensed fluid pressure in the wellbore. Hydraulic fluid pressure supplied to the rotating control device 10 may be maintained in the range of from about 200 psi to 2000 psi greater than wellbore pressure.

As shown on the left side of FIG. 1, pressurized fluid flows under the lower end of the adapter ring 64, through the bearing 76, then up the annular gap between the adapter ring 64 and the lower housing 14. Pressurized fluid continues to flow past the bearing 84, then between an outer surface of the rotatable inner housing 38 and an inner surface of the upper housing 16. The seals 70, 71 and 72 provide sealed engagement between the piston 56 and the adapter ring 64. Elastomeric seal 86 provides sealed engagement between the adapter ring 64 and the inner housing 38.

Pressurized fluid thus fills the chamber 92 surrounding the thrust bearing 40. In order to lubricate and cool the bearings, hydraulic fluid is continually circulated through the rotating control device 10. In order to generate the pressure needed to move the piston 56 and actuate the annular sealing assembly 46, the pressurized fluid is forced through a restriction formed between the flow bushing 114 and the inner housing sleeve 44. The seal cartridge 116 then forces the fluid into the fluid output port 27. The restriction formed by the flow bushing 114 and the inner housing sleeve 44 creates the backpressure needed to maintain hydraulic pressure in closing chamber 90.

Figure 2:
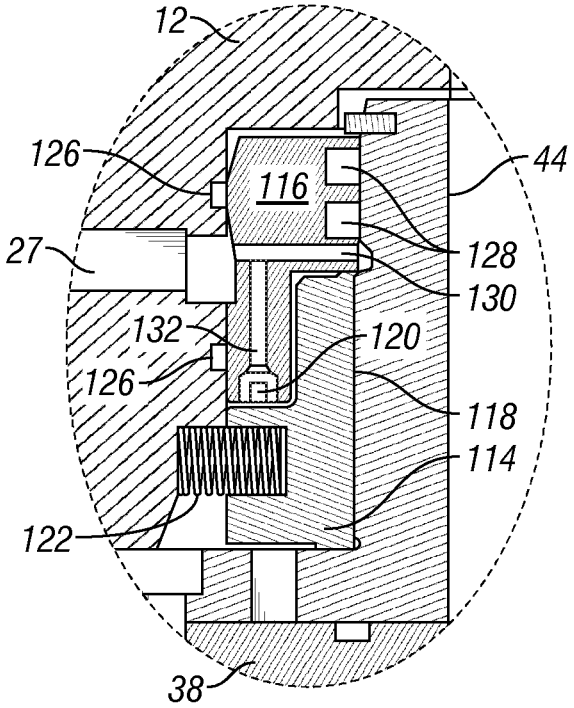
FIG. 2 is a sectional view of a portion of the rotating control device of FIG. 1.

Referring now to FIG. 2, flow bushing 114 and seal cartridge 116 are disposed between the rotating inner housing sleeve 44 and the stationary outer housing 12. The inner housing sleeve 44 has an outer diameter that is slightly smaller than the inner diameter of the flow bushing 114 so that a gap 118 is formed between the components. The seal cartridge 116 includes static seals 126 and upper rotary seals 128 that force hydraulic fluid to flow through flow passageways 130 or 132 to fluid output port 27. Flow passageway 132 may be fitted with an orifice 120 to control the division of flow through the passageways. The flow through flow passageway 130 is primarily made up of flow that passes through the gap 118.

As previously discussed, the flow bushing 114 and seal cartridge 116 provide a restriction to the flow of hydraulic fluid as it moves past the inner housing sleeve 44 and into fluid output port 27. The primary flow path for hydraulic fluid into fluid output port 27 is through gap 118 between the inner housing sleeve 44 and the flow bushing 114. Variations in gap 118 due to manufacturing tolerances or dynamic movement of the components can lead to fluctuations in the pressure developed by the flow restriction and contact between the inner housing sleeve 44 and the flow bushing 114. Contact between the components can lead to damage or excessive wear on the components while pressure fluctuations can have a negative impact on the performance of the rotating control device 10.

In order to overcome these issues, a hydrodynamic journal bearing can be generated between the inner housing sleeve 44 and the flow bushing 114. In order to create a hydrodynamic journal bearing, a viscous lubricant is supplied to the gap between a rotating journal that is eccentrically placed within a bearing surface. The hydraulic fluid that operates the rotating control device 10 serves as the lubricant. One or more bushing springs 122 are disposed between the outer housing 12 and the flow bushing 114 so as to urge the flow bushing into an eccentric position relative to the inner housing sleeve 44.

Figure 3:
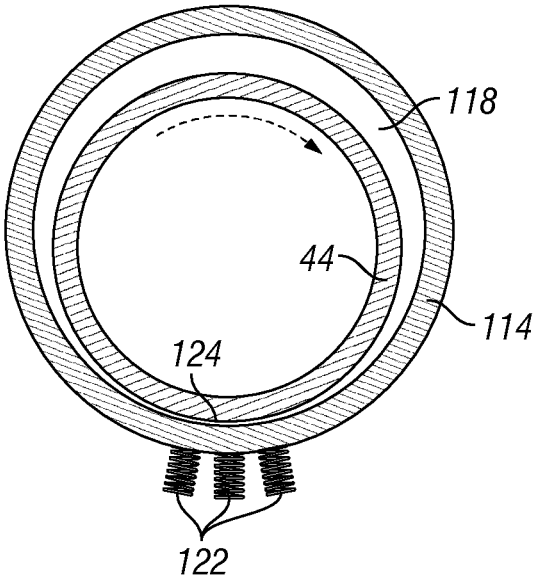
FIG. 3 is a partial sectional schematic view of a portion of the rotating control device of FIG. 1.

As schematically shown in FIG. 3, the bushing springs 122 are arranged to create a convergence 124 between the inner housing sleeve 44 and the flow bushing 114. As the fluid pressure of the hydraulic fluid forces fluid into the gap 118, the rotational motion of the inner housing 44 relative to the flow bushing 114 pulls hydraulic fluid into the convergence 124. The hydraulic fluid is compressed in the convergence 124 to form a hydrodynamic journal bearing that separates the inner housing sleeve 44 from the flow bushing 114.

In certain embodiments, the outer surface of the inner housing sleeve 44 may be coated with Babbitt or another soft metal bearing material. In contrast, the inner surface of the flow bushing 114 may be hardened to resist wear. The bushing springs 122 may be compression springs constructed from metal, elastomeric material, or other materials. In certain embodiments, the bushing springs 122 may be hydraulic springs that allow for the spring force to be controlled.

While the disclosure is susceptible to various modifications and alternative forms, specific embodiments thereof are shown by way of example in the drawings and description. It should be understood, however, that the drawings and detailed description thereto are not intended to limit the disclosure to the particular form disclosed, but on the contrary, the intention is to cover all modifications, equivalents and alternatives falling within the spirit and scope of the present disclosure.

What is claimed is:

1. A rotating control device comprising:

an outer housing defining a bore therein for receiving a tubular member;

an inner housing rotatably disposed within the outer housing;

a piston assembly rotatably disposed within the outer housing;

an annular sealing assembly disposed between the piston assembly and the inner housing, wherein axial movement of the piston assembly moves the annular sealing assembly into sealing engagement with the inner housing and the tubular member;

a hydrodynamic journal bearing that is formed between an inner housing sleeve that is coupled to the inner housing and a flow bushing that is coupled to the outer housing; and means for urging the flow bushing into an eccentric position relative to the inner housing.

2. The rotating control device of claim 1, wherein the means for urging the flow bushing into an eccentric position relative to the inner housing comprises a bushing spring disposed between the outer housing and the flow bushing.

3. The rotating control device of claim 1, wherein an outer surface of the inner housing sleeve is coated with a soft metal bearing material.

4. The rotating control device of claim 1, wherein an inner surface of the flow bushing is hardened.

5. The rotating control device of claim 1, further comprising a fluid input port and a fluid output port disposed through the outer housing and in fluid communication with each other and with the hydrodynamic journal bearing.

6. The rotating control device of claim 5, further comprising a closing chamber defined by the piston and the outer housing, wherein the closing chamber is in fluid communication with the hydrodynamic journal bearing.

7. A rotating control device comprising:

an outer housing defining a bore therein for receiving a tubular member;

an inner housing rotatably disposed within the outer housing;

an annular sealing assembly supported within the inner housing for sealed engagement with the tubular member;

a rotatable piston axially movable within the outer housing, wherein axial movement of the rotatable piston causes radially inward movement of the annular sealing assembly; and a hydrodynamic journal bearing that is formed between an inner housing sleeve that is coupled to the inner housing and a flow bushing that is coupled to the outer housing; and means for urging the flow bushing into an eccentric position relative to the inner housing.

8. The rotating control device of claim 7, wherein the means for urging the flow bushing into an eccentric position relative to the inner housing comprises a bushing spring disposed between the outer housing and the flow bushing.

9. The rotating control device of claim 7, wherein an outer surface of the inner housing sleeve is coated with a soft metal bearing material.

10. The rotating control device of claim 7, wherein an inner surface of the flow bushing is hardened.

11. The rotating control device of claim 7, further comprising a fluid input port and a fluid output port disposed through the outer housing and in fluid communication with each other and with the hydrodynamic journal bearing.

12. The rotating control device of claim 11, further comprising a closing chamber defined by the piston and the outer housing, wherein the closing chamber is in fluid communication with the hydrodynamic journal bearing.

13. A method for operating a rotating control device comprising:

disposing an inner housing, a piston assembly, and an annular sealing assembly within an outer housing, wherein the inner housing, piston assembly, and the annular sealing assembly are supported by a plurality of bearings disposed between the inner housing and the outer housing that allow the inner housing, piston assembly, and the annular sealing assembly to rotate relative to the outer housing, and wherein one of the plurality of bearings is a hydrodynamic journal bearing that is formed between an inner housing sleeve that is coupled to the inner housing and a flow bushing that is coupled to the outer housing, wherein the rotating control device also includes means for urging the flow bushing into an eccentric position relative to the inner housing; and providing a pressurized fluid to the hydrodynamic journal bearing.

14. The method of claim 13, further comprising providing a pressurized fluid to a closing chamber defined by the piston and the outer housing so as to move the piston axially relative to the outer housing.

15. The method of claim 14 wherein the closing chamber is in fluid communication with the hydrodynamic journal bearing.

16. The method of claim 13, further comprising a bushing spring disposed between the outer housing and the flow bushing.

17. The method of claim 13, wherein an outer surface of the inner housing sleeve is coated with a soft metal bearing material and an inner surface of the flow bushing is hardened.

* * * * *